US008328302B2

(12) United States Patent
Kim et al.

(10) Patent No.: US 8,328,302 B2
(45) Date of Patent: Dec. 11, 2012

(54) REFRIGERATOR DRAWER AND REFRIGERATOR HAVING THE SAME

(75) Inventors: Jun Hee Kim, Gyeongsangnam-do (KR); Ki Hong Park, Busan (KR); Min Hun Kim, Busan (KR); Sang Hu Park, Seoul (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 12/832,109

(22) Filed: Jul. 8, 2010

(65) Prior Publication Data

US 2011/0018414 A1 Jan. 27, 2011

(30) Foreign Application Priority Data

Jul. 22, 2009 (KR) ..... 10-2009-0066834

(51) Int. Cl.
*A47B 88/08* (2006.01)

(52) U.S. Cl. ..... 312/404; 312/334.45; 312/334.8

(58) Field of Classification Search ..... 312/401, 312/402, 404, 330.1, 334.1, 334.7, 334.44, 312/334.45, 334.8; 62/382, 440
See application file for complete search history.

(56) References Cited

U.S. PATENT DOCUMENTS

| | | | | |
|---|---|---|---|---|
| 136,869 | A * | 3/1873 | Rose | 312/334.8 |
| 2,056,407 | A * | 10/1936 | Metcalf | 312/334.32 |
| 3,751,126 | A * | 8/1973 | Hudson | 384/23 |
| 6,457,790 | B1 * | 10/2002 | Liang et al. | 312/334.46 |
| 7,240,980 | B2 * | 7/2007 | Koons | 312/404 |
| 2002/0033657 | A1 * | 3/2002 | Kim et al. | 312/334.12 |
| 2006/0049731 | A1 * | 3/2006 | Choi et al. | 312/330.1 |
| 2008/0202146 | A1 * | 8/2008 | Lim et al. | 62/382 |

* cited by examiner

*Primary Examiner* — James O Hansen
*Assistant Examiner* — Sasha T Varghese
(74) *Attorney, Agent, or Firm* — Fish & Richardson P.C.

(57) ABSTRACT

A refrigerator drawer and a refrigerator having the same are disclosed. The refrigerator drawer includes a storage box forwardly movable in a storage chamber provided in a cabinet; and a supporting member provided in the storage chamber to support the storage box; a guide member provided between the supporting member and the storage box, the guide member secured to the storage box, and being relatively-movable with respect to the storage box and the supporting member, wherein the guide member is movably connected to the storage box and the guide member comprises at least one guiding slot configured to guide the relative-motion with the storage box.

20 Claims, 7 Drawing Sheets

REFRIGERATOR DRAWER AND REFRIGERATOR HAVING THE SAME

CROSS REFERENCE TO RELATED APPLICATION

This application claims the benefit of the Patent Korean Application No. 10-2009-0066834, filed on Jul. 22, 2009, which is hereby incorporated by reference as if fully set forth herein.

BACKGROUND OF THE DISCLOSURE

1. Field of the Disclosure

The present invention relates to a refrigerator drawer and a refrigerator having the same, more particularly, to a refrigerator which can improve user convenience.

2. Discussion of the Related Art

In general, refrigerators are electric appliances which can freeze and refrigerate food stuffs by using a refrigerant cycle configured of compression, condensation, expansion and evaporation to preserve them fresh.

A conventional structure of such a refrigerator includes a cabinet including a storage chamber such as a freezing chamber and a refrigerating chamber, a door provided in the cabinet to open and close the storage chamber and shelves and drawers provided in the storage chamber to keep a variety of storing objects therein.

In addition, a supporting member projected inward is provided in the storage chamber to support the shelves and drawers and the shelves and drawers may be movable with respect to such the supporting member, if necessary.

The refrigerator uses the refrigerator cycle configured of the compression, condensation, expansion and evaporation to freeze or refrigerate storing objects such as food stuffs.

Especially, the drawer may be frequently used as container of vegetables and fruits and the like and the usage of the drawer is quite often. When a user pulls the drawer, the drawer happens to separate from the supporting member and to be detached forwardly.

That is, the user can pull the drawer until a rear part of the drawer is exposed outside, to store the storing objects in an inner rear portion of the drawer. If then, the drawer might be detached from the supporting member.

Because of that, it is required to add an extracting distance of the drawer from the storage chamber and to enable the drawer not to be detached from the supporting member.

SUMMARY OF THE DISCLOSURE

Accordingly, the present invention is directed to a refrigerator drawer and a refrigerator having the same.

An object of the present invention is to provide a refrigerator drawer including a storage box forwardly relative-movable with respect to the guide member, to enable the storage box to be additionally moved in a forward direction, even if motion of a guide member with respect to a supporting member is limited.

Another object of the present invention is to a refrigerator drawer which can secure stability not for the storage box to fall down, when it is drawn out, by connecting a rib provided in the storage box with the guide member, and a refrigerator having the same.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator drawer includes a storage box forwardly movable in a storage chamber provided in a cabinet; a supporting member provided in the storage chamber to support the storage box; a guide member provided between the supporting member and the storage box, the guide member secured to the storage box, with relatively-movable with respect to the storage box and the supporting member, wherein the guide member may be movably connected to the storage box and the guide member comprises at least one guiding slot configured to guide the relative-motion with the storage box.

In another aspect of the present invention, a refrigerator includes a cabinet comprising a storage chamber; and a refrigerator drawer provided in the storage chamber, the refrigerator drawer forwardly movable, wherein the refrigerator drawer may include a storage box forwardly movable in a storage chamber provided in a cabinet; a supporting member provided in the storage chamber to support the storage box; and a guide member provided between the supporting member and the storage box, the guide member secured to the storage box, with relatively-movable with respect to the storage box and the supporting member, wherein the guide member is movably connected to the storage box and the guide member comprises at least one guiding slot configured to guide the relative-motion with the storage box.

According to the present invention, there are following advantageous effects.

First, the forwardly moving distance of the storage box is added and the user can keep storing objects in an overall space inside the storage box accordingly.

Furthermore, even with the added moving distance of the storage box, the storage box may not fall down from the supporting member and stability of the storage box can be secured accordingly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
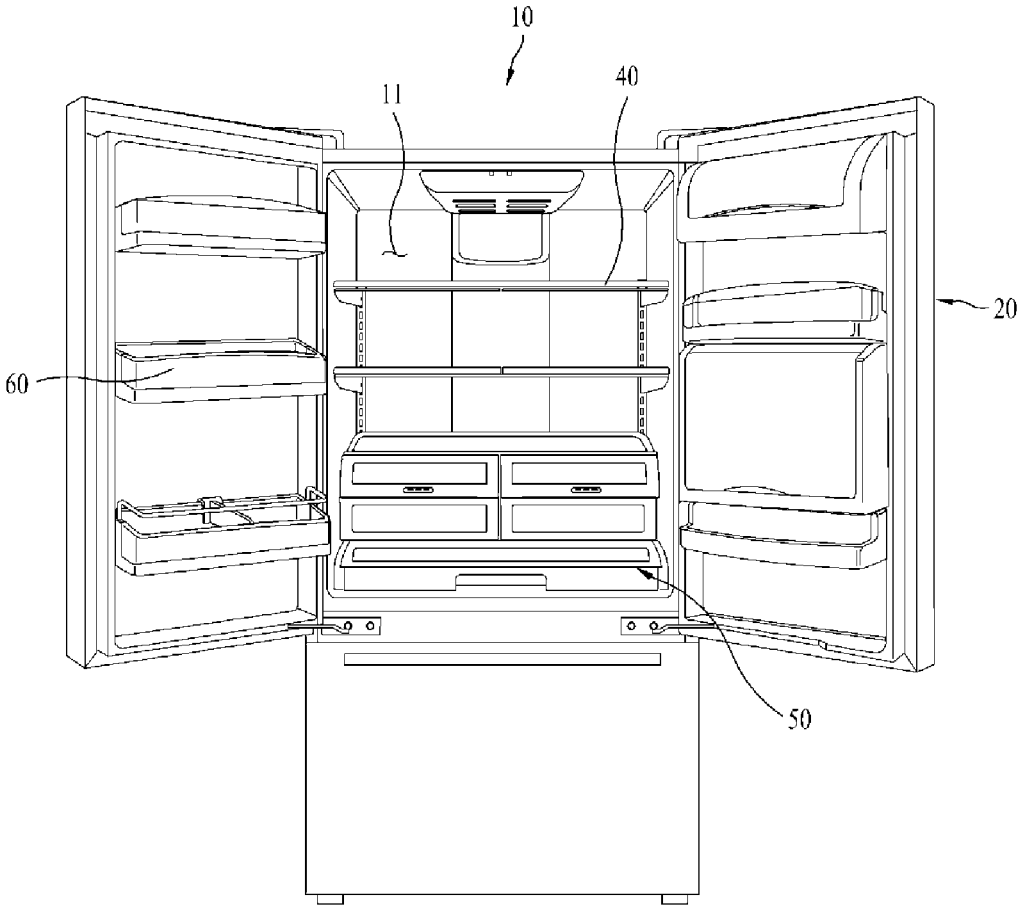
FIG. 1 is a front view illustrating a refrigerator according to the present invention

FIG. 1 is a front view illustrating a refrigerator according to the present invention. In reference to FIG. 1, an overall configuration and operation of the refrigerator according to the present invention will be described in detail.

As shown in FIG. 1, the refrigerator according to the present invention includes a cabinet 10 in which a storage chamber 11 is provided, and a door 20 rotatably coupled to the cabinet 10.

According to the drawings, a refrigerating chamber is placed on a top portion of the storage chamber 11 and a freezing chamber is placed in a bottom portion of the storage chamber 11 and the present invention is not limited thereto. For example, the present invention may be applicable to a top mount type model having a freezing chamber placed in a top or a side-by-side type model having refrigerating and freezing chambers arranged side by side.

The storage chamber 11 includes a shelf 40 on which storing objects are placed and a storage box 50 provided below the shelf, with a predetermined storage space.

Here, the storage box 50 provided in a predetermined floor of the storage chamber 11 may be configured of plural drawers or a single drawer.

A door pocket 60 is provided in an inner surface of the door 20 and the door pocket 60 can form a predetermined storage space.

Here, the storage box 50 is movably provided in the storage chamber 11. If a user pulls the storage box 50, the storage box 50 will be drawn forwardly with respect to the storage chamber 11.

Figure 2:
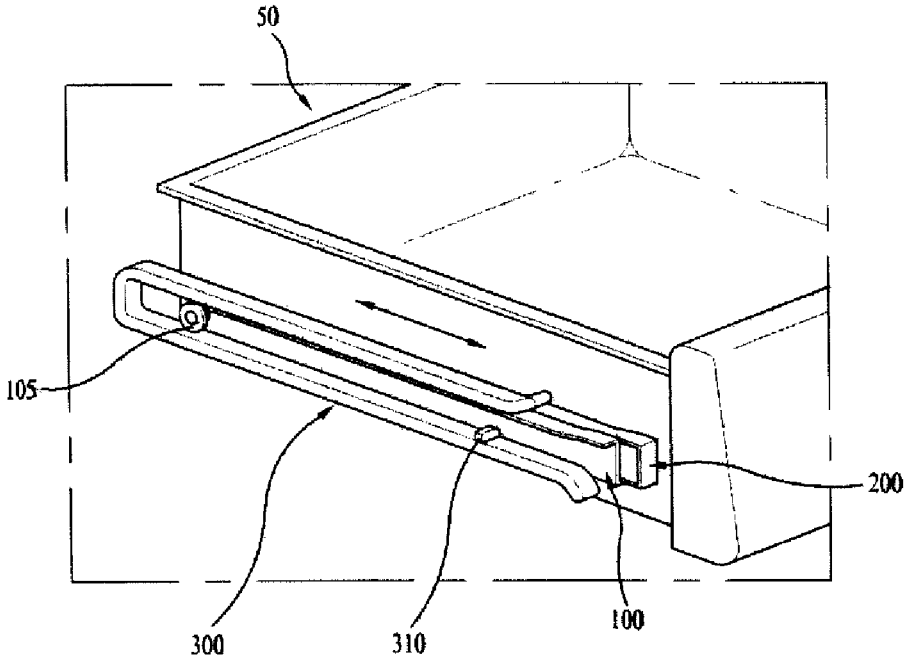
FIG. 2 is a perspective view illustrating a storage box supported by a supporting member in a refrigerator drawer according to the present invention.

FIG. 2 is a perspective view illustrating the storage box supported by a supporting member inside the refrigerator drawer. In reference to FIG. 2, the configuration of the refrigerator drawer and the process of drawing out the storage box will be described in detail.

Figure 6:
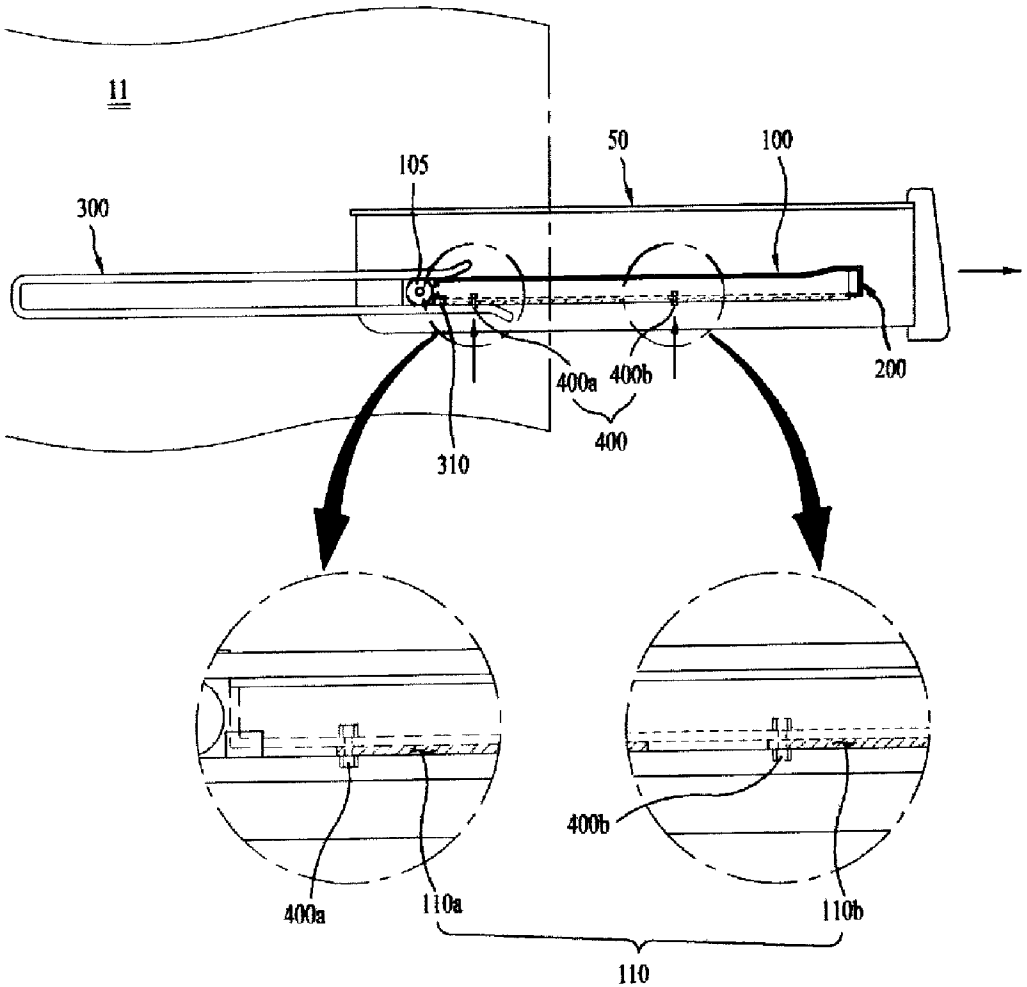

As shown in FIG. 6, the storage box 50 may be movable forward and backward inside the storage chamber 11.

A supporting member 300 is provided in an inner wall of the storage chamber (11, see FIG. 1), supportingly connected with the guide member 100 to guide the motion of the guide member 100.

The supporting member 300 includes a guiding part configured to seat the guide member 100 therein, with an open front part and a closed rear portion, and a supporting part configured to support the guide member 100 connected with the storage box 50 when the storage box 50 is moved out.

The guide member 100 is provided between a side surface of the storage box 50 and the supporting member 300 to enable the storage box 50 to move. That is, the guide member 100 is relative-movably secured to the storage box 50 with respect to the storage box 50 and the supporting member 300.

Here, the guide member 100 is not fixed to the side surface of the storage box 50 but movably secured to the side surface to enable the storage box 50 to move with respect to the guide member 100. For that, ribs 200 connected with the guide member 100 are provided in both opposite sides of the storage box 50.

The guide member 100 is provided outer to the rib 200 to cover the rib 200.

A roller 105 is provided in a rear end of the guide member 100 to improve the motion efficiency of the guide member 100 and the storage box 50 and the roller 105 is seated on the supporting member to move.

A stopper 310 is provided in a front portion of the supporting member 300 to stop the motion of the roller 105. When the user draws the storage box 50 out, the stopper 310 limits the motion of the guide member 100 with respect to the supporting member.

At this time, although the motion of the guide member 100 with respect to the supporting member 300 is limited, the rib 200 provided in the side surface of the storage box 50 is moving with respect to the guide member 100. The storage box 50 may be additionally drawn toward the outside of the storage chamber.

That is, the storage box 50 may be movable forwardly as far as a length of a guide slot (110, see FIG. 3), which will be described later.

Figure 3:
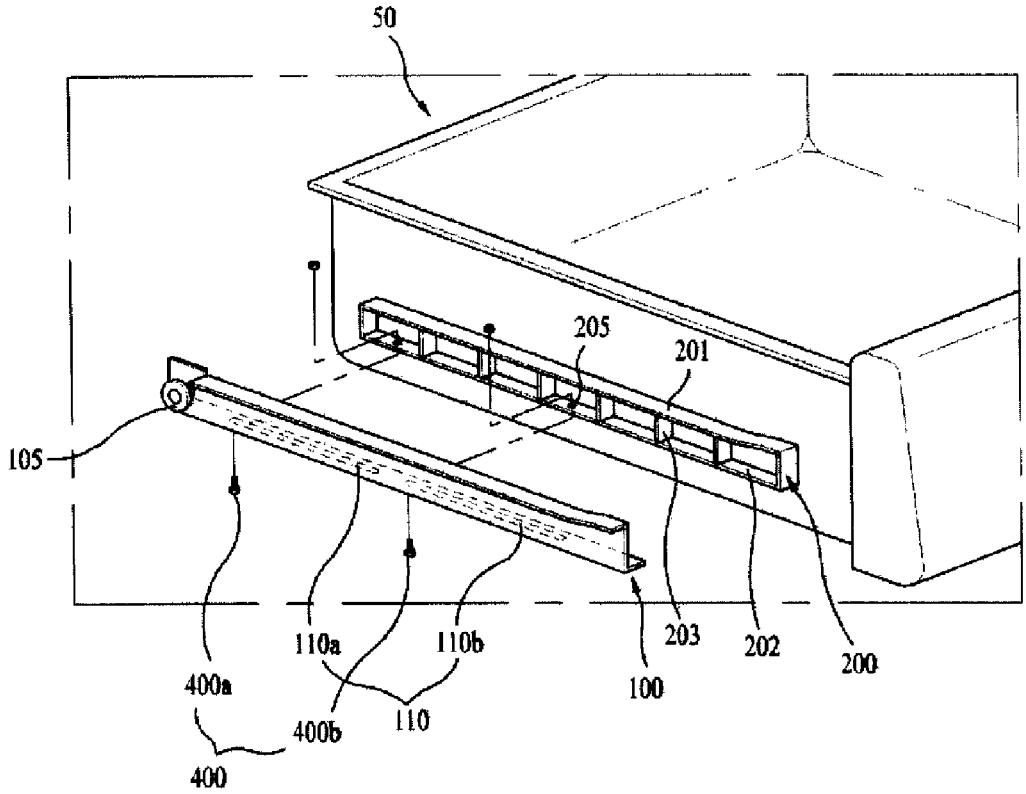
FIG. 3 is an exploded perspective view illustrating a guide member secured to the storage box in the refrigerator drawer.

FIG. 3 is an exploded perspective view illustrating the guide member which is secured to the storage box inside the refrigerator drawer. In reference to FIG. 3, the relative motion between the storage box and the guide member will be described in detail.

As shown in FIG. 3, the ribs 200 are provided in both opposite side surfaces of the storage box 50 and they may be integrally formed with the storage box 50.

The rib 200 includes a rectangular-shaped upper horizontal rib 201, a rectangular-shaped lower horizontal rib 202 seated on the guide member 100, spaced apart a predetermined distance from the upper horizontal rib 201, and at least on reinforcing rib 203 connected between the upper horizontal rib 201 and the lower horizontal rib 202, to reinforce rigidity.

The rib 200 is movable with respect to the guide member 100. In case the motion of the guide member 100 with respect to the supporting member 300 is limited, the rib 200 is moving with respect to the guide member 100 to enable the storage box 50 to be additionally drawn out.

The guide member 100 includes a rectangular-shaped vertical plate member 132 seated in an end of the rib 200, a first horizontal plate member 133 vertically bent from an end of the vertical plate member 132 to seat the lower horizontal rib 202 seat thereon and a second horizontal plate member 130 horizontally bent from the other end of the vertical plate member 132 in an opposite direction of the first horizontal plate member 133 to seat the supporting member 300 therein.

Here, the second horizontal plate member 130 supports the storage box 50 with respect to the supporting member 300, when the storage box 50 is drawn out. As a result, in case the storage box 50 is additionally drawn out, the storage box 50 may be prevented from falling down because of its weight and the weight of the storing objects.

The rib 200 may be secured to relative-move with respect to the guide member 100. For that, a hollow-shaped guiding slot 110 formed in a longitudinal direction of the guide member 100 may be provided in a lower surface of the guide member 100, that is, in the first horizontal plate member 133.

That is, the guiding slot 110 guides the motion of the storage box 50, when the storage box 50 is drawn in and out along the relative-motion with the guide member 100.

At least one securing member 400 is provided to secure the guide member 100 with the rib 200 and the securing member 400 is secured to the lower horizontal rib 202 via the guiding slot 110.

For that, an inserting hole 205 is provided in the lower horizontal rib 202 to allow the securing member 400 inserted therein.

As a result, an end of the securing member 400 is inserted in the inserting hole 205 of the lower horizontal rib 202, via the guiding slot 110, to be secured to the rib 200. The other end of the securing member 400 may be exposed outside a bottom surface of the guide member 100, that is, the first horizontal plate member 133.

In this state, the width of the other end of the securing member may be larger than the rightward and leftward width of the guiding slot 110, to prevent the rib 200 and the guide member 100 from being disconnected.

Here, the rib 200 and the guide member 100 might be disassembled as necessary. Because of that, the securing member 400 may be a rivet or bolt and the other end of the securing member 400 may be bolt head-shaped or rivet head-shaped, looking engaged to the guiding slot 110.

According to an embodiment, a plurality of securing members 400 and a plurality of guiding slots 110 may be provided, spaced apart a predetermined distance from each other. according to the drawing, the securing member 400 includes first and second securing members 400*a* and 400*b* and the guiding slot 110 includes first and second guiding slots 110*a* 110*b*, as the present invention is not limited thereto.

Here, the first securing member 400*a* may be adjacent to a rear end of the lower horizontal rib 202 of the rib 200 and the second securing member 400*b* may be forwardly spaced apart a predetermined distance from the first securing member 400*a*.

The guiding slot 400 includes the first and second guiding slots 400*a* and 400*b* which are arranged in a forward and backward direction.

Here, the distance between the first and second securing members 400*a* and 400*b* may be corresponding to the distance between a front end of the first guiding slot 110*a* and a front end of the second guiding slot 110*b*.

That is because a locus of the relative motion between the first securing member 400*a* and the first guiding slot 110*a* had better be identical to a locus of the relative motion between the second securing member 400*b* and the second guiding slot 110*b*.

When the stopper (310, see FIG. 2) stops the motion of the roller 105 to limit the motion of the guide member 100, the storage box 50 is additionally drawn out. At this time, this additional motion is guided by the first and second guiding slots 110*a* and 110*b*. If the storage box 50 is drawn more forwardly, the first and second securing members 400*a* and 400*b* located in the rear ends of the first and second guiding slots 110*a* and 110*b*, respectively, may move toward the front ends of the first and second guide members 110*a* and 110*b*. When the front ends of the first and second guiding slots 110*a* and 110*b* contact with the first and second securing members 400*a* and 400*b*, the additional motion of the storage box 50 in a forward direction may be limited.

That is, the motion of the securing member 400 may be stopped by the end of the guiding slot 110 to limit the relative-motion between the storage box 50 and the guiding member 100.

As a result, to enable the first and second securing members 400*a* and 400*b* and the first and second guiding slot 110*a* and 110*b* to contact with each other simultaneously, the distance between the first and second securing members may be substantially identical to the distance between the front end of the first guiding slot 110*a* and the front end of the second guiding slot 110*b*, as mentioned above.

The roller 105 arranged in the rear end of the rail 100 is identical to the configuration mentioned above and the detailed description thereof will be omitted.

Figure 4:
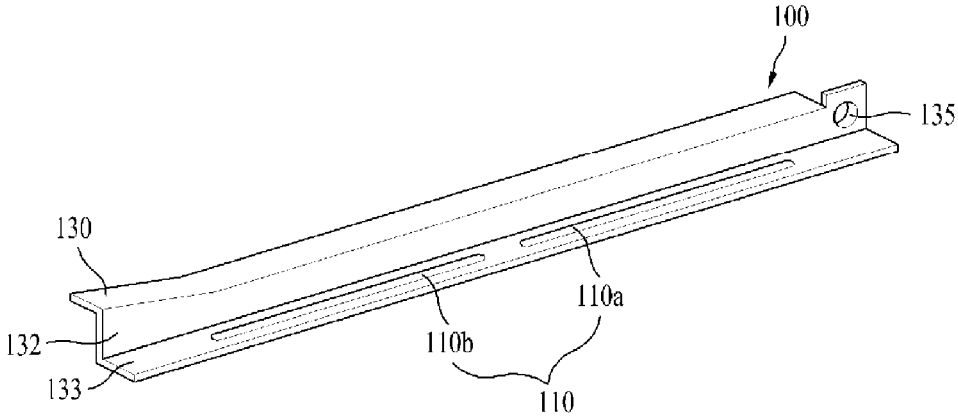
FIG. 4 is a perspective view illustrating the guide member of the refrigerator drawer according to the present invention.

FIG. 4 is a perspective view illustrating the guide member 100 of the refrigerator drawer according to the present invention. In reference to FIG. 4, the configuration and the appearance of the guide member 100 will be described in detail.

As shown in FIG. 4, the length of each first and second guiding slot 110*a* and 110*b* is corresponding to the additional motion distance of the storage box 50 which has to be secured. It is preferable that the plurality of the guiding slots 110 are provided to secure stability and the drawing-motion distance simultaneously.

If the guide slot is a single long hollow, the storage box 50 might be moved forwardly to the guide member 100 too much only to fall down.

The guide member 100 includes the vertical plate member 132, the first horizontal plate member 133 and the second horizontal plate member 130, as mentioned above. An installation hole 135 is provided in the vertical plate member 132 to install the roller 105 therein rotatably.

Here, the lower horizontal rib (202, see FIG. 3) is seated on the first horizontal plate member 133 and the vertical plate member 132 is seated on the end of the reinforcing rib (203, see FIG. 3). As a result, the rib (200, see FIG. 3) is movably connected with the guide member 100.

Figure 5:
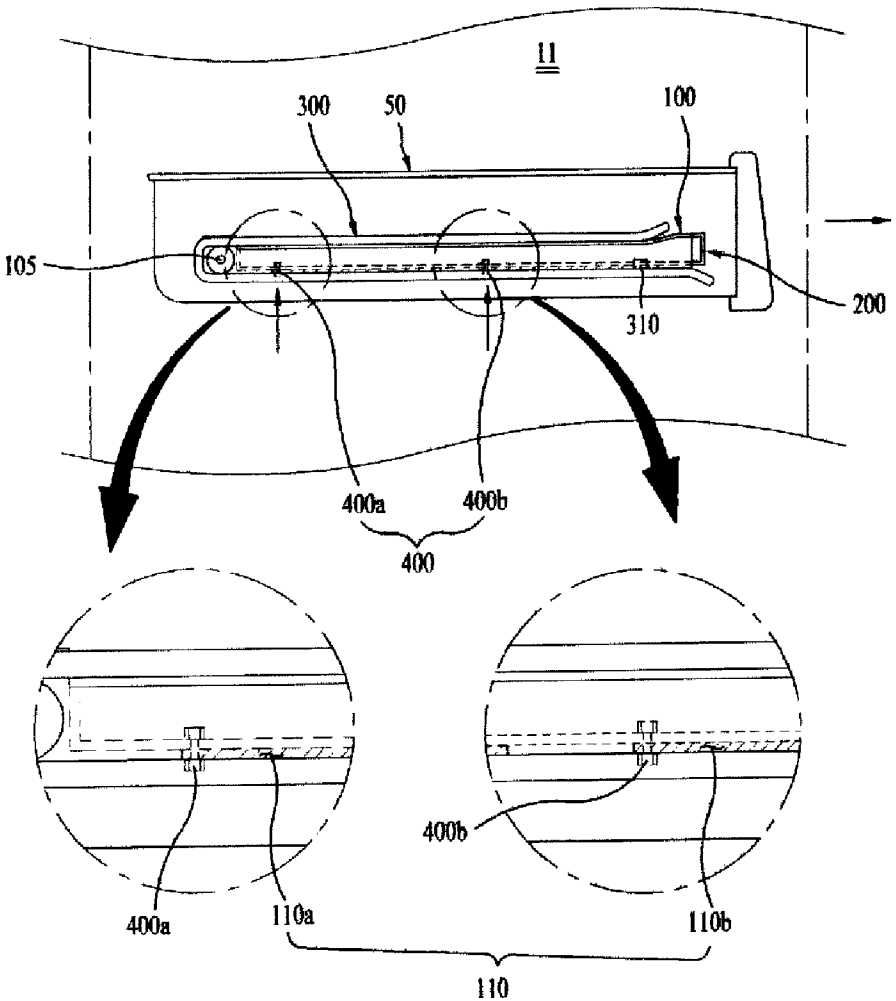
FIGS. 5 to 7 are side sectional views illustrating the storage box which is drawing from the refrigerator drawer.
Figure 7:
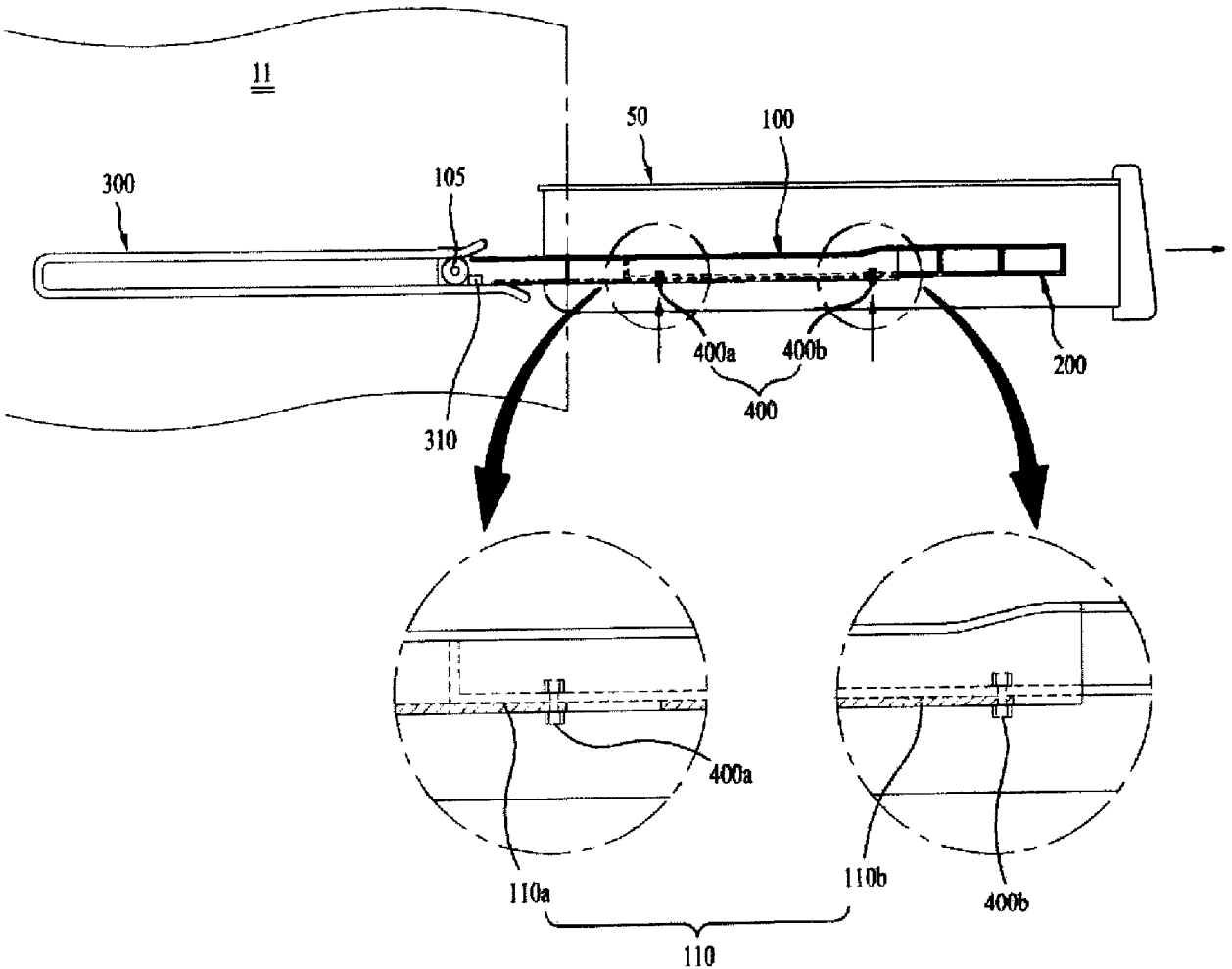

FIGS. 5 to 7 are side views illustrating the storage box 50 which is drawn out from the refrigerator drawer. As follows, the operational process of the storage box 50 when it is additionally drawn will be described in reference to FIGS. 5 to 7.

As shown in FIG. 5, when the storage box 50 is located in the storage chamber 11, the roller 105 is located in the rear portion of the supporting member 300 and the first and second securing members 400*a* and 400*b* are located in the rear ends of the first and second guiding slots 110*a* and 10*b*, respectively.

When the user pulls the storage box 50 forwardly in this state, the storage box 50 and the guide member 100 may move forwardly. The guide member 100 is moving forwardly until the roller 105 is stopped by the stopper 310.

Even at this time, the first and second securing members 400*a* and 400*b* are located in the rear ends of the first and second guiding slots 110*a* and 110*b*, respectively.

When the user continuously pulls the storage box 50 in the state of the roller 105 being stopped by the stopper 310, only the storage box 50 is moved forwardly. At this time, the first and second securing members 400*a* and 400*b* are moving to the front ends of the first and second guiding slots 110*a* and 110*b*, as shown in FIG. 6.

When the first and second securing members 400*a* and 400*b* are slotted by the front ends of the first and second guiding slots 110*a* and 110*b*, the forward motion of the storage box 50 is finished.

When the storage box 50 is drawn out completely, almost of the inner space of the storage box 50 may be exposed outside and the user can put and take out the storage objects efficiently and conveniently.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator drawer comprising:

a storage box forwardly movable in a storage chamber provided in a cabinet;

a supporting member provided in the storage chamber to support the storage box;

a guide member provided between the supporting member and the storage box, the guide member secured to the storage box, and being relatively-movable with respect to the storage box and the supporting member, wherein the guide member is movably connected to the storage box and the guide member comprises a guiding slot configured to guide the relative-motion with the storage box;

a rib protruding from a side surface of the storage box, wherein the rib is slidably supported by the guide member and the rib comprises:

a lower horizontal rib seated on the guide member, an upper horizontal rib configured to, when the storage box is moved forwardly, support the storage box with respect to the supporting member, and at least one reinforcing rib connected between the upper horizontal rib and the lower horizontal rib;

a roller provided in a rear end of the guide member to move with respect to the supporting member; and a securing member configured to pass through the guiding slot and the rib to secure the rib to the guide member, wherein the supporting member protrudes from a side wall of the storage chamber and is configured to surround the roller.

2. The refrigerator drawer of claim 1, wherein the guiding slot is extended in a longitudinal direction of the guide member.

3. The refrigerator drawer of claim 1, wherein the rib is relatively-movable with respect to the guide member to allow the storage box to be moved forwardly when the motion of the guide member with respect to the supporting member is limited.

4. The refrigerator drawer of claim 1, wherein the securing member passes through the guiding slot and the lower horizontal rib and the securing member guides the lower horizontal rib along the guiding slot.

5. The refrigerator drawer of claim 4, wherein the securing member and an end of the guiding slot are contactable with each other to limit the relative-motion between the storage box and the guide member.

6. The refrigerator drawer of claim 4, wherein the guiding slot is a first guiding slot defined in the guide member as a hollow shape and the securing member is a first securing member provided in a lower surface of the rib, further comprising:

a second guiding slot defined in the guide member as a hollow shape, the second guiding slot being separate from the first guiding slot; and a second securing member provided in a lower surface of the rib and spaced a predetermined distance from the first securing member, the first securing member passing through the first guiding slot and the second securing member passing through the second guiding slot.

7. The refrigerator drawer of claim 6, wherein a distance between front ends of the first and second guiding slots corresponds to a distance between the first and second securing members.

8. The refrigerator drawer of claim 4, wherein the securing member comprises a first end secured to the rib and a second end exposed outside a lower surface of the rib, and the width of the second end is larger than the width of the guiding slot to prevent the rib and the guide member from being disassembled.

9. The refrigerator drawer of claim 1, wherein the supporting member comprises, a guide part configured to seat the guide member thereon;

a stopper provided in a front end of the guide part to stop the motion of the roller; and a supporting part configured to support the guide member when the storage box is moved forwardly.

10. The refrigerator drawer of claim 9, wherein the roller and the stopper are contactable with each other to limit the relative-motion between the supporting member and the guide member.

11. The refrigerator drawer of claim 1:

wherein the lower horizontal rib includes an inserting hole; and wherein a first end of the securing member is inserted in the inserting hole of the lower horizontal rib via the guiding slot and a second end of the securing member is exposed outside a bottom surface of the guide member.

12. The refrigerator drawer of claim 1, further comprising:

a stopper configured to stop movement of the roller, wherein, when the storage box is in a fully inserted position, the storage box slides forward on the roller until the roller is stopped by the stopper, wherein the guide member does not slide relative to the rib during forward movement of the storage box prior to the stopper stopping the roller, and wherein, after the stopper stops the roller, the storage box slides forward based on the lower horizontal rib sliding directly on a surface of the guide member until the securing member contacts an end of the guiding slot to stop the lower horizontal rib sliding directly on the surface of the guide member.

13. The refrigerator drawer of claim 1, wherein the at least one reinforcing rib comprises multiple reinforcing ribs that each connect the upper horizontal rib to the lower horizontal rib at an interior position of the upper horizontal rib and the lower horizontal rib, the interior position including positions spaced interior of ends of the upper horizontal rib and the lower horizontal rib.

14. The refrigerator drawer of claim 1, wherein the guide member comprises:

a rectangular-shaped vertical plate member seated in an end of the rib;

a first horizontal plate member vertically bent from a first end of the vertical plate member to seat the lower horizontal rib thereon; and a second horizontal plate member vertically bent from a second end of the vertical plate member in an opposite direction of the first horizontal plate member to seat the supporting member thereon, the second end of the vertical plate member being opposite of the first end of the vertical plate member.

15. A refrigerator comprising;

a cabinet comprising a storage chamber; and a refrigerator drawer provided in the storage chamber, the refrigerator drawer being forwardly movable, wherein the refrigerator drawer comprises a storage box forwardly movable in the storage chamber;

a supporting member provided in the storage chamber to support the storage box;

a guide member provided between the supporting member and the storage box, the guide member secured to the storage box, and being relatively-movable with respect to the storage box and the supporting member, wherein the guide member is movably connected to the storage box and the guide member comprises a guiding slot configured to guide the relative-motion with the storage box;

a rib protruding from a side surface of the storage box, wherein the rib is slidably supported by the guide member and the rib comprises:

a lower horizontal rib seated on the guide member, an upper horizontal rib configured to, when the storage box is moved forwardly, support the storage box with respect to the supporting member, and at least one reinforcing rib connected between the upper horizontal rib and the lower horizontal rib;

a roller provided in a rear end of the guide member to move with respect to the supporting member; and a securing member configured to pass through the guiding slot and the rib to secure the rib to the guide member, wherein the supporting member protrudes from a side wall of the storage chamber and is configured to surround the roller.

16. The refrigerator of claim 15, wherein the rib is relatively-movable with respect to the guide member to allow the storage box to be moved forwardly when the motion of the guide member with respect to the supporting member is limited.

17. The refrigerator of claim 15, wherein the securing member passes through the guiding slot and the lower horizontal rib and the securing member guides the lower horizontal rib along the guiding slot.

18. The refrigerator of claim 17, wherein the securing member and an end of the guiding slot are contactable with each other to limit the relative-motion between the storage box and the guide member.

19. The refrigerator of claim 15, wherein the supporting member comprises, a guide part configured to seat the guide member thereon;

a stopper provided in a front end of the guide part to stop the motion of the roller; and a supporting part configured to support the guide member when the storage box is moved forwardly.

20. The refrigerator of claim 19, wherein the roller and the stopper are contactable with each other to limit the relative-motion between the supporting member and the guide member.

* * * * *